US007341109B1

(12) United States Patent
McDowell

(10) Patent No.: US 7,341,109 B1
(45) Date of Patent: Mar. 11, 2008

(54) HYDRAULIC FLOW CONTROL SYSTEM WITH AN INTERNAL COMPENSATOR SLEEVE

(76) Inventor: Bobby Dewain McDowell, 14 Newberry Ct., Montgomery, TX (US) 77356

( * ) Notice: Subject to any disclaimer, the term of this patent is extended or adjusted under 35 U.S.C. 154(b) by 0 days.

(21) Appl. No.: 11/698,512

(22) Filed: Jan. 26, 2007

(51) Int. Cl.
*E21B 19/16* (2006.01)

(52) U.S. Cl. ..... 166/379; 166/78.1; 166/95.1

(58) Field of Classification Search ..... 166/379, 166/380, 78.1, 79.1, 85.4, 95.1, 97.1
See application file for complete search history.

(56) References Cited

U.S. PATENT DOCUMENTS 1,894,912 A 1/1933 Otis
4,423,774 A 1/1984 Mefford
4,442,892 A 4/1984 Delesandri
4,846,271 A 7/1989 Delesandri
5,092,399 A 3/1992 Lang
5,213,157 A 5/1993 Wills
5,806,589 A 9/1998 Lang
6,189,620 B1 2/2001 McDowell
6,488,094 B1 12/2002 McDowell

*Primary Examiner*—William P Neuder
(74) *Attorney, Agent, or Firm*—Mary J. Gaskin

(57) ABSTRACT

A compensator sleeve assembly for use with a hydraulic extension system used to handle safety valves designed to shut off high pressure upward flow through drill pipe or tubing. The compensator sleeve assembly, amounted on an adjustable arm slide, has a steel sleeve for holding the safety valve, an arrangement of circumferentially space-apart spring sets which allow the safety valve to "float" and tilt from the vertical in any direction and a hydraulic-powered chain drive belt for rotating the safety valve.

7 Claims, 12 Drawing Sheets

HYDRAULIC FLOW CONTROL SYSTEM WITH AN INTERNAL COMPENSATOR SLEEVE

FIELD OF THE INVENTION

The present invention relates to an improved apparatus for handling safety valves used for shutting off high pressure upward flow through drill pipe or tubing.

BACKGROUND OF THE INVENTION

When an oil well is being drilled, drilling personnel may encounter an unexpected high pressure situation requiring them to install a safety valve into the top of the drill pipe or tubing, from which uncontrolled high pressure fluids and gases are flowing.

Various methods are presently used to attempt such installation. The methods share a common feature of positioning the safety valve over the drill pipe while the valve is suspended by a cable, chain or rope catline. Typically, drilling personnel are required to physically align the end of the safety valve (which can weigh from 50 to 300 pounds) with the top of the drill pipe (which may be 5 to 10 feet off the working floor), while fluids and gases are escaping. If flowing pressures do not exceed 50 psi, the present methods can be successful. However, higher pressures can result in serious injury to personnel, either by movement of the suspended safety valve or impact from blown fragments of sand and gravel. If a safety valve cannot be installed, the only recourse is to allow the blowout to continue until the pressurized fluids are exhausted, or until the formation collapses, with detrimental environmental repercussions.

In U.S. Pat. No. 6,189,620, this inventor described an apparatus for installing a safety valve. In U.S. Pat. No. 6,488,094, this inventor described a similar apparatus with an improvement for stabilizing the hydraulic unit in extremely high pressure situations.

The present invention is directed to overcoming the problems associated with installing a suspended safety valve when the drilling or workover rig floor is not level.

SUMMARY OF THE INVENTION

The present invention utilizes a previously-described three-stage double-acting hydraulic extension system to hold and stab a safety valve into the top of a drill pipe or tubing during a high pressure situations. The hydraulic extension system can be mounted on a base with wheels, which move on a track. If a track cannot be used, the system can be mounted on lockable caster wheets. Mounted on the platform next to the hydraulic extension system may be a telescoping, mechanically-extending stanchion; a plate connects the top of the stanchion to the top of the hydraulic extension system. Attached to the hydraulic extension system is an extended arm to which a steel plate is attached, which has been drilled to hold the safety valve within an internal compensator sleeve, thereby allowing an operator to maintain a positive pin by box connection make up when floor slopes are uneven. Also attached to the hydraulic unit is a positioning arm, which is placed against the drill pipe or tubing in order to vertically align the safety valve. Alternatively, hydraulic tongs can be used. The length of both arms can be adjusted as necessary, by using the locking bolts or adjusting the hydraulic cylinders. When not in use, the arms are out of the way. When the system is activated, the extended arm is rotated into position to align the safety valve directly over the drill pipe or tubing. The three-stage double-acting hydraulic extension system can raise the extension arm high enough vertically (up to 12 feet) to allow the operator to stabilize the safety valve, then lower it, without exposing drilling personnel to the well's high pressures. Alternatively, an I-beam with gear track, or a screw drive system, can be used to raise and lower the safety valve. The hydraulic extension system can exert a downward force in excess of 10,000 pounds through the extension arm, thereby preventing an oil well blowout the possibility of a fire, and environmental damage. The optional stanchion, which extends and retracts along with the hydraulic extensions, prevents any rotational movement of the hydraulic extensions. After lowering the valve into the drill pipe or tubing, the hydraulic extension system can hold the valve in position while the operator makes up the safety valve pin by box connection with the drilling string and closes the well in. The arrangement of springs inside the compensator sleeve assembly gives it a moment of movement that allows the safety valve to "float" and tilt, in any direction. As a result, the pin of the safety valve can be threaded into the end of the drill pipe even when the rig floor is not level. Powered by hydraulics, a chan drive belt system rotates the safety valve, both clockwise and counterclockwise. Because the present invention greatly reduces the length of time required to install a safety valve in unexpected high pressure situations, its use greatly improves safety for drilling personnel.

It is an object of the present invention to provide an apparatus to hold and stab a safety valve into a drill pipe or tubing when gases and liquids are flowing therefrom in an uncontrolled manner, even when the rig floor is not level.

It is another object of the present invention to provide an apparatus that is operated remotely, thereby keeping drill personnel away from hazardous conditions.

A further object of the present invention is to provide an apparatus with a compensator sleeve assembly, which allows the valve to tilt in any direction, making it possible for it to be screwed into the box end of a drill pipe, even when the rig floor slopes up to 100 in any direction.

It is still another object of the present invention to provide an apparatus which operates quickly and efficiently to bring a well under control.

Yet another object of the present invention is to prevent equipment damage, prevent fires, prevent environmental damage, and protect working personnel.

DESCRIPTION OF A PREFERRED EMBODIMENT

Figure 1:
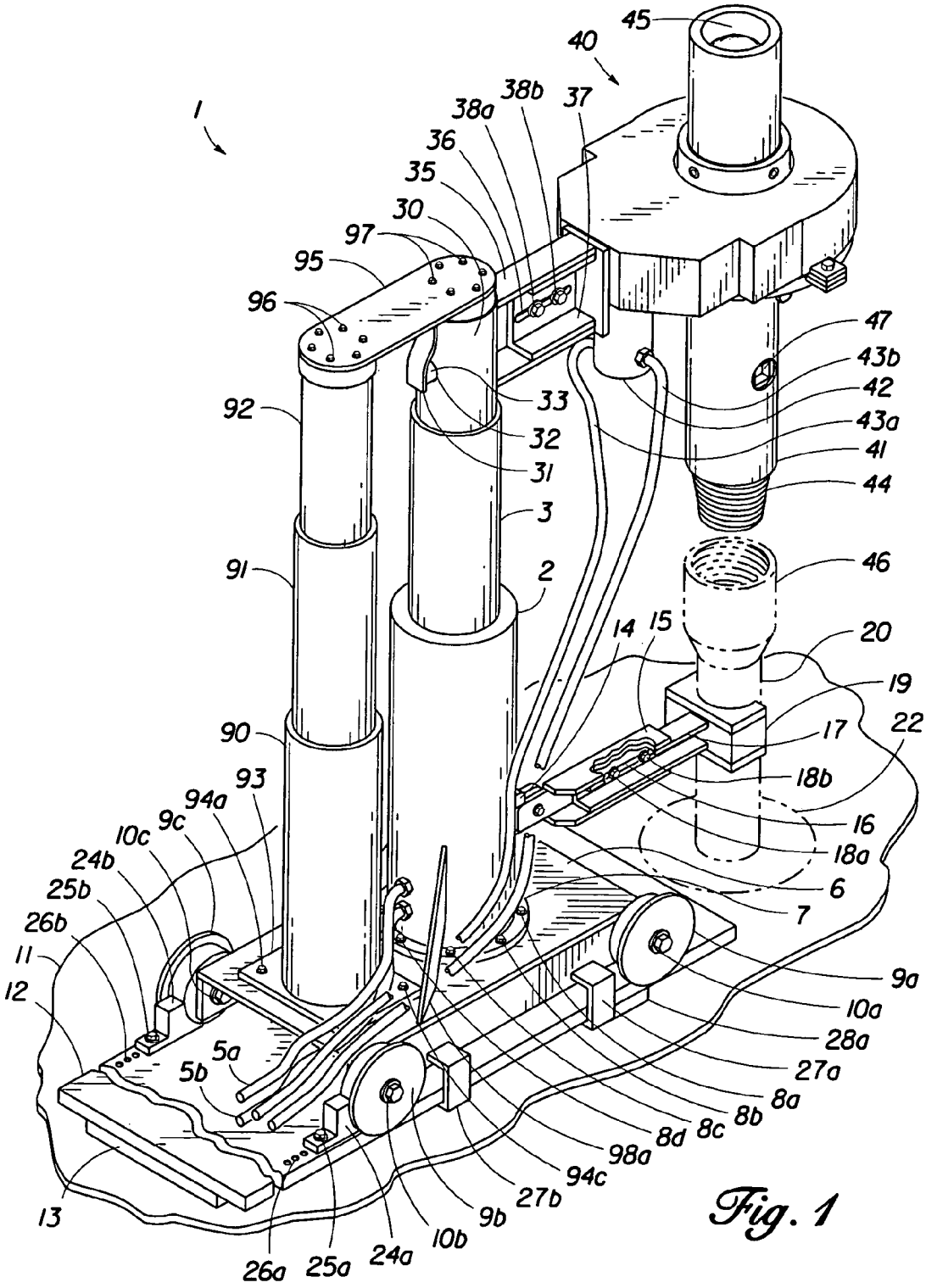
FIG. 1 is an isometric view of an embodiment of the flow control system of the present invention.

Referring to FIG. 1, the apparatus 1 of the present invention is shown in an operational position. The apparatus utilizes a three-stage double-acting, telescoping, hydraulic extension system, comprising a stainless steel hydraulic unit 2 with a first hydraulic cylinder extension 3 and a second hydraulic cylinder extension 4 telescoping upwardly, with power supplied by a remote hydraulic pump (not shown) through hydraulic hoses 5*a*, 5*b*. The hydraulic unit 2 is supported by a base 6, and is attached thereto by base plate 7 with bolts 8*a*, 8*b*, 8*c*, 8*d*, 8*e*. A mechanically-extending, telescoping stanchion 90 is mounted on the base 6 next to the hydraulic unit 2. The machine-fit stainless steel stanchion 90, with a first stanchion extension 91 and a second stanchion extension 92, is attached to the base 6 by base plate 93 with bolts 94*a*, (94*b*), 94*c*, (94*d*). One end of a stabilizing plate 95 is bolted to the top of second stanchion extension 92 with bolts 96. The other end of stabilizing plate 95 is bolted to the top of second stanchion extension 92 with bolts 96. The other end of stabilizing plate 95 extends over and is bolted onto the top of the second hydraulic cylinder extension 4 with bolts 97. The first stanchion extension 91 and the second stanchion extension 92 move upwardly and downwardly with the movement of the first hydraulic cylinder extension 3 and the second hydraulic cylinder extension 4. The stanchion 90 prevents the first hydraulic cylinder 3 and the second hydraulic cylinder extension 4 from any rotational movement about the longitudinal axis of the hydraulic unit 2. Gussets 98*a* (98*b*), which stabilize the hydraulic unit 2, are welded to the hydraulic unit 2 and the base 6. Steel wheels 9*a*, 9*b*, 9*c* (9*d* not shown) with outer flanges (i.e., mining car wheels) are mounted onto the sides of the base 6 with holding bolts 10*a*, 10*b*, 10*c* (10*d* not shown). The apparatus 1 has been guided to a ready position by moving it along track assembly 11, generally formed by welding together two rectangular steel plates (each at least ¼" thick), with the upper track plate 12 having a wider dimension than the lower track plate 13. Mounted on the hydraulic unit 2 is a positioning bar slide 15 with a slot 16, generally a steel I-beam. A slot (not shown) in yoke slide 17, also a steel I-beam, has been aligned with the slot 16 in positioning bar slide 15, and bolts 18*a*, 18*b*, have been inserted in the slot 16 and fastened. Welded to the yoke slide 17 is formed yoke 19, which is positioned against the drill pipe or tubing 20, which is supported by rotary table 22. After the apparatus 1 is in position, further movement of the wheels 9*a*, 9*b*, 9*c*, 9*d* is prevented by using locking stops 24*a*, 24*b*, which are secured by inserting pins 25*a*, 25*b* into the positioning holes (e.g., 26*a*, 26*b*). Steel safety clamps 27*a*, 27*b*, (27*c* and 27*d*, on opposite side, not shown) prevent vertical movement of the apparatus 1, which might otherwise result as a result of high pressure upward forces from the well. A stop block 28*a* (28*b*, on opposite side, not shown) welded to the underside of upper track plate 12 keeps the hydraulic unit 2 from rolling towards the drill pipe 20.

Mounted on the second hydraulic cylinder extension 4 is a steel swivel bearing sleeve 30 with a steel spring 31 attached thereto. A spring-loaded stainless steel plug bolt 32 inserted in plug bolt hole 33 locks the swivel bearing sleeve 30 in place for operation.

Welded to the swivel bearing sleeve 30 is an extended arm slide 35 with a slot (not shown), generally a steel I-beam. A slot 36 in adjustable arm slide 37, also a steel I-beam, has been aligned with the slot in extended arm slide 35, and bolts 38*a*, 38*b* have been inserted in the slot 36 and fastened. Welded to the adjustable arm slide 37 is steel plate (39) with compensator sleeve assembly 40, which holds the safety valve 41 in a vertical position. Mounted on the steel plate (39) is hydraulic motor 42, with hoses 43*a*, 43*b*; it has an output of +/−200 foot pounds of torque for rotating the safety valve 41.

In operation, the double-acting hydraulic unit 2 lowers the pin end 44 on the safety valve 41 into the well's flow, which is directed through the upper opening 45 of the safety valve 41. The downward pressure created by the three-stage hydraulic unit 2 is greater than the well's formation pressure, allowing remotely-located drill personnel to lower the pin end 44 on the safety valve 41 into the box end 46 of the drill pipe or tubing 20 and to hold the safety valve 41 in place, with rotational power supplied by the hydraulic motor 42. The pin end 44 on the safety valve 41 is screwed into the threads of the drill pipe or tubing 20, and the connection is tightened. A crewmember closes the ball valve 47 located near the bottom of the safety valve 41, thereby closing off the flow of fluids and gases until proper well kill methods can be implemented. During no time is a crewmember exposed to the direct flow of fluids or gases from the well.

Alternatively, an I-beam with gear track, or a screw drive system, can be used to raise and lower the safety valve.

Figure 2:
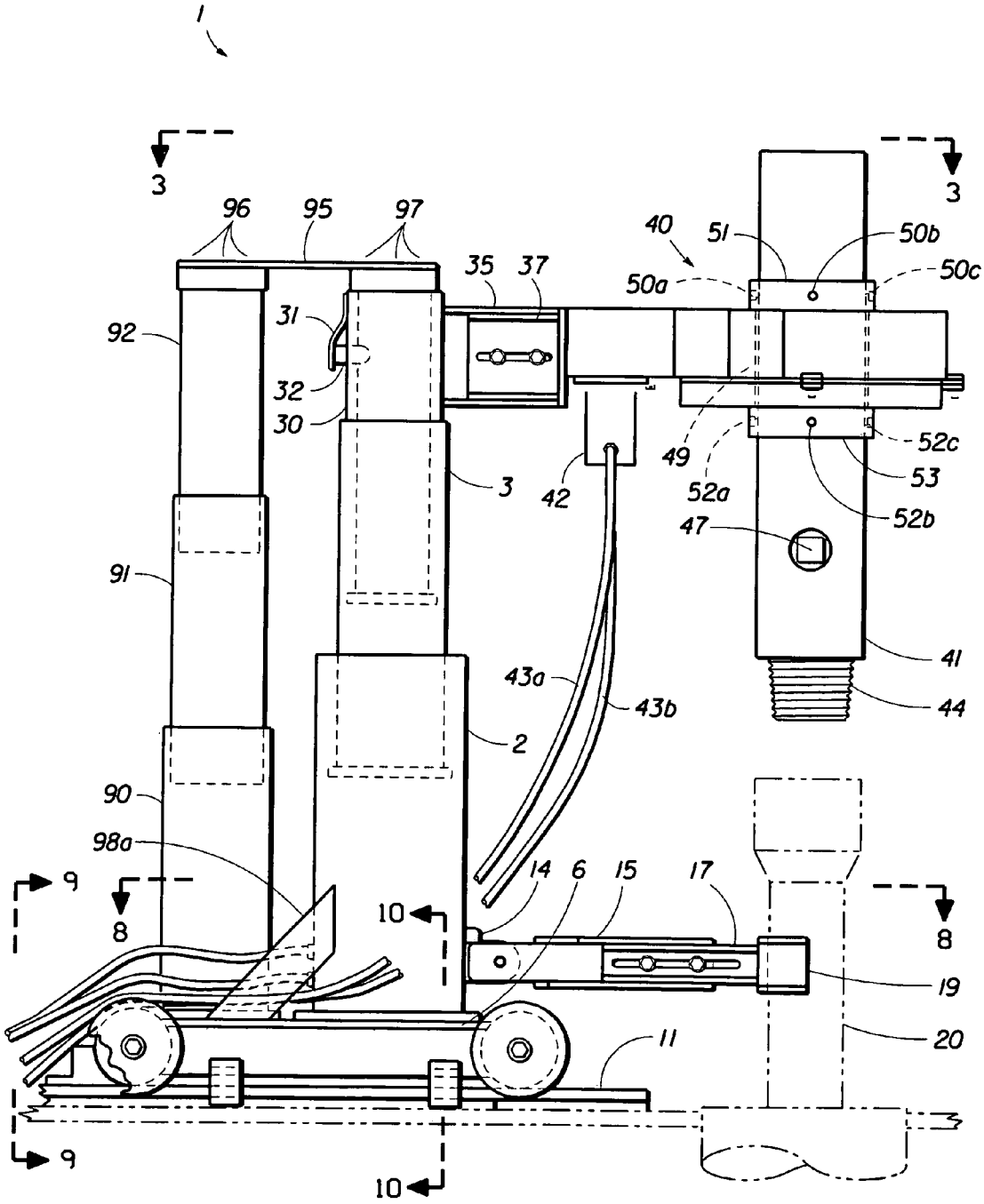
FIG. 2 is a side view of the present invention, showing the extended arm with the compensator sleeve assembly holding the safety valve above the open drill pipe or tubing, and showing the positioning arm against the drill pipe or tubing.

FIG. 2 is a side view of the apparatus 1, showing the hydraulic unit 2 and the stanchion 90 on base 6. The apparatus 1 has been pulled into position on the track assembly 11, and the yoke 19 has been positioned against the drill pipe 20. The first hydraulic cylinder extension 3 and second hydraulic cylinder extension 4 have raised the compensator sleeve assembly 40 into position above the drill pipe 20. The first stanchion extension 91 and the second stanchion extension 92 have telescoped upwardly along with the first hydraulic cylinder extension 3 and the second hydraulic cylinder extension 4, to which the stabilizing plate 95 is bolted. The safety valve 41 with pin end 44 is positioned inside the sleeve 49 of compensator sleeve assembly 40 and prevented from vertical movement therein by four hex set screws 50*a*, 50*b*, 50*c*, (50*d*) screwed through openings in top sleeve flange 51 and four hex set screws 52*a*, 52*b*, 52*c*, (52*d*) screwed through openings in bottom sleeve flange 53. Power to the compensator sleeve assembly 40 is supplied by hydraulic motor 42, with hoses 43*a*, 43*b*.

Figure 3:
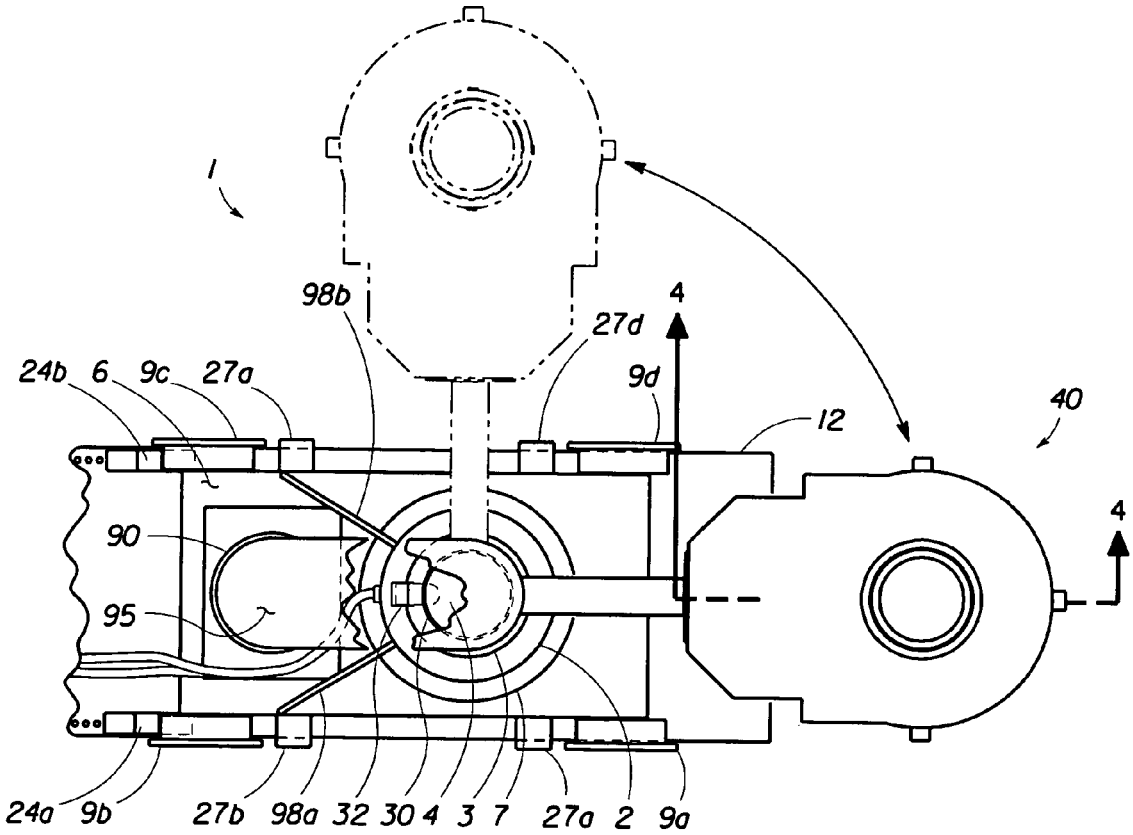
FIG. 3 is a top view of the present invention, showing the extended arm and compensator sleeve assembly rotated between a ready position and an operational position.

The top view of FIG. 3 shows the compensator sleeve assembly 40 in a ready position (shown with dotted lines) and in an operational position, after the arm has been rotated 90° horizontally and the plug bolt 32 has locked the swivel bearing sleeve 30 in place. The flanges of wheels 9*a*, 9*b*, 9*c*, 9*d* extend over the sides of the upper track plate 12. Locking stops 24*a*, 24*b*, 24*c*, 24*d* prevent the apparatus 1 from rolling away from the drill pipe 20. Safety clamps 27*a*, 27*b*, 27*c*, 27*d* prevent vertical movement of the apparatus 1. The stabilizing plate 95 prevents any rotational movement of the hydraulic extension system. Gussets 98*a*, 98*b* help stabilize the hydraulic unit 2

Figure 4:
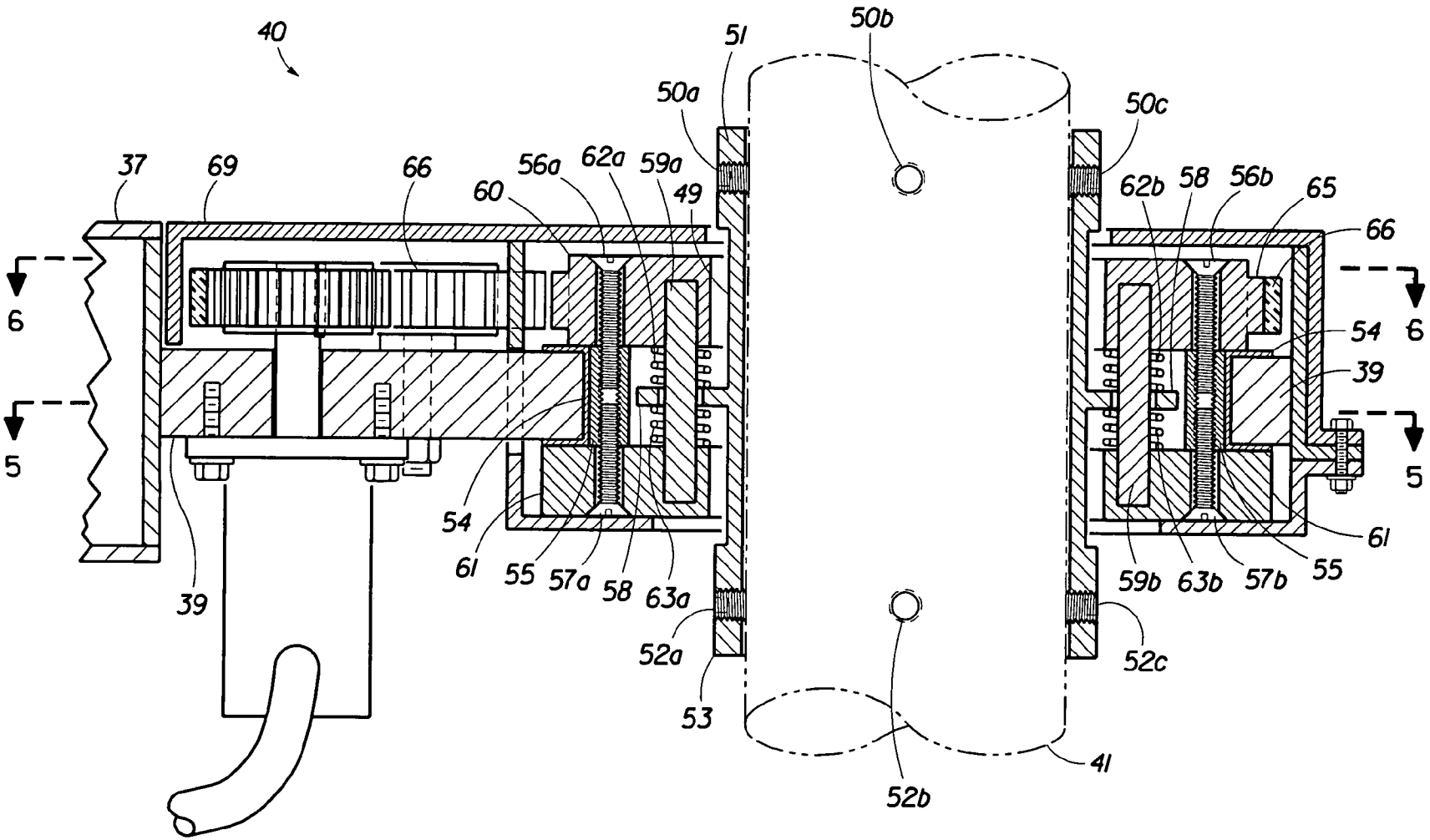
FIG. 4 is a cross-sectional side view of the compensator sleeve assembly showing the steel plate and sleeve holding the safety valve.

As shown in FIG. 4, the compensator sleeve assembly 40 is designed to rotate the safety valve 41 as it is screwed into the box end 46 of a drill pipe 20. Welded onto the adjustable arm slide 37 is a 1½" thick steel plate 39, which is bored out to 12" I.D. A U-shaped, 3-sided teflon bearing 54 is installed around the inner bore of the steel plate 39. A cut piece of steel pipe 55, with dimensions of 12" O.D.×11" I.D.×1½" in height and with a smooth bore, is disposed in the bore of the steel plate 39, where it acts like a bushing. The cut steel pipe 55 is tapped for upper set screws 56*a*, 56*b* and lower set screws 57*a*, 57*b*. Disposed inside the bore of the cut steel pipe 55 is the steel sleeve 49, which has a top sleeve flange 51, a bottom sleeve flange 53, and an intermediate sleeve support flange 58. The safety valve 41 has been positioned inside the bore of the sleeve 49, where it is held in place by hex screws 50*a*, 50*b*, 50*c*, (50*d*) screwed through openings in the top sleeve 51, and by hex screws 52*a*, 52*b*, 52*c*, (52*d*) screwed through openings in bottom sleeve flange 53. The sleeve support flange 58 has been drilled for insertion of stainless steel rotator rods 59*a*, 59*b* (others are not shown in this cross-sectional view), which are equally spaced apart circumferentially. Upper steel block 60, which has been bored to accommodate the steel valve 49, has been tapped for insertion of set screws 56*a*, 56*b* and its lower surface drilled to hold the upper ends of the rotator rods 59*a*, 59*b*. Lower steel block 61, which has also been bored to accommodate the steel valve 49, has been tapped for insertion of set screws 57*a*, 57*b* and its upper surface drilled to hold the lower ends of rotator rods 59*a*, 59*b*. Both upper steel block 60 and lower steel block 61 are optimally made from stainless steel. When the present invention is assembled, the upper steel block 60 is disposed above the cut steel pipe 55 and the upper ends of the rotator rods 59*a*, 59*b*, and the lower steel block 61 is disposed below the cut steel pipe 55 and the lower ends of the rotator rods 59*a*, 59*b*. Each stainless steel upper spring 62*a*, 62*b* is placed over the upper end of a rotation rod 59*a*, 59*b*, which is then inserted into upper steel block 60, and each stainless steel lower spring 63*a*, 63*b* is placed over the lower end of a rotator rod 59*a*, 59*b*, which is then inserted into the lower steel block 61. The springs 62, 63 are made of steel; the number of spring sets (an upper spring 62 and a lower spring 63) used in each assembly, as well the tension of the springs selected, is determined by the size and weight of the safety valve 41 used. Typically between 9 and 12 sets of springs (18 to 24 total) are used; altogether the springs are able to support a safety valve 41 weighing up to 375 lbs. Each of the sets of springs acting as a compensator, allowing the safety valve 41 in the sleeve 49 to "float" and tilt in any direction, so that it can be screwed into the box end 46 of drill pipe when the floor slopes up to 10 degrees from horizontal, in any direction.

After the upper springs 62 and lower springs 63 are installed, the upper steel block 60 and the lower steel block 61 are then "sandwiched" together, and set screws 56*a*, 56*b*, are screwed into the openings in the upper steel block 60, and set screws 57*a*, 57*b* are screwed into the openings in the lower steel block 61. A gear cog sprocket 65 is welded to the perimeter of upper steel block 60, and a power chain drive belt 66 is placed thereon, driven by drive gear sprocket 67. The present invention was built with a Gates power chain drive belt (GT2) made of rubber, nylon and steel strands; the teeth on the inner surface are tapered so they stay engaged. A Martin gear system was used to turn the safety valve 41, powered by the hydraulic motor 42. The teflon bearing 54 allows the upper steel block 60 and the lower steel block 61 to slide smoothly around the steel plate 39 as the compensator sleeve assembly 40 rotates. A cover guard 69 made of sheet metal provides protection to (and from) the moving parts of the assembly.

Figure 5:
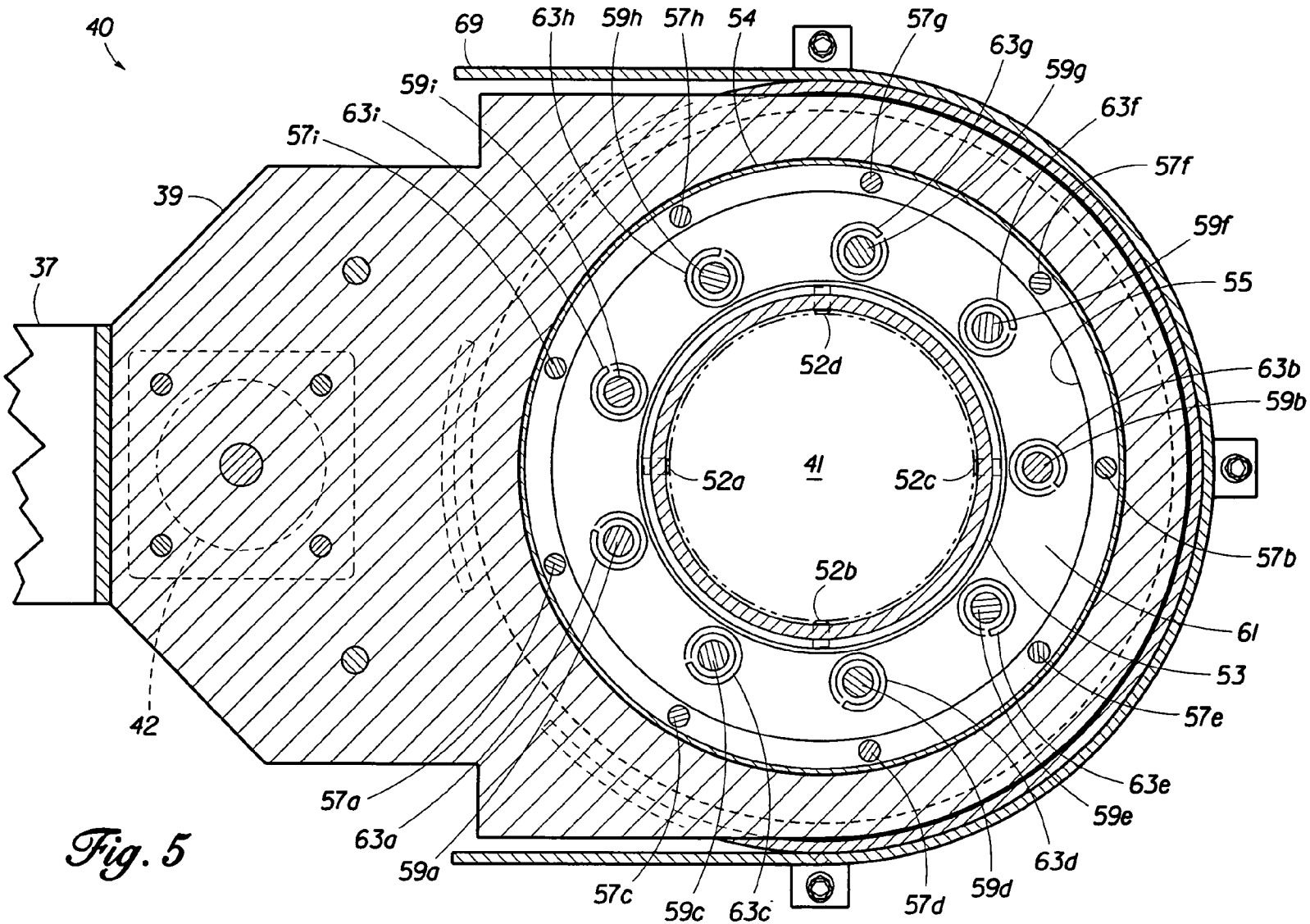
FIG. 5 is a cross-sectional view of the compensator sleeve assembly taken along line 5-5 of FIG. 4.

FIG. 5 is a cross-sectional view of the compensator sleeve assembly 40 of the present invention taken below the horizontal centerline of FIG. 4. Welded to the adjustable arm slide 37 is the steel plate 39, which has been bored out to accommodate cut steel pipe 55. Around the inside of the steel plate 39 is a three-sided teflon bearing 54, which abuts the outside surface of the steel pipe 55. Disposed inside the steel pipe 55 is the sleeve 49 holding the safety valve 41, which is held in place by hex set screws 52*a*, 52*b*, 52*c*, 52*d* screwed through the bottom sleeve flange 53. The sleeve 49 can hold a safety valve 41 having an outer diameter ranging from 4 to 8 inches; for valves with an O.D. less than 8 inches, longer hex set screws are used. An end of each rotator rod 59*a*, 59*b*, 59*c*, 59*d*, 59*e*, 59*f*, 59*g*, 59*h*, 59*i*, each holding a lower spring 63*a*, 63*b*, 63*c*, 63*d*, 63*e*, 63*f*, 63*g*, 63*h*, 63*i*, has been inserted into one of the drilled openings in the topside of lower steel block 61. Set screws 57*a*, 57*b*, 57*c*, 57*d*, 57*e*, 57*f*, 57*g*, 57*h*, 57*i*, are screwed into cut steel pipe 55 to hold the assembly in place. Cover guard 69 provides protection from the moving parts of the assembly.

Figure 6:
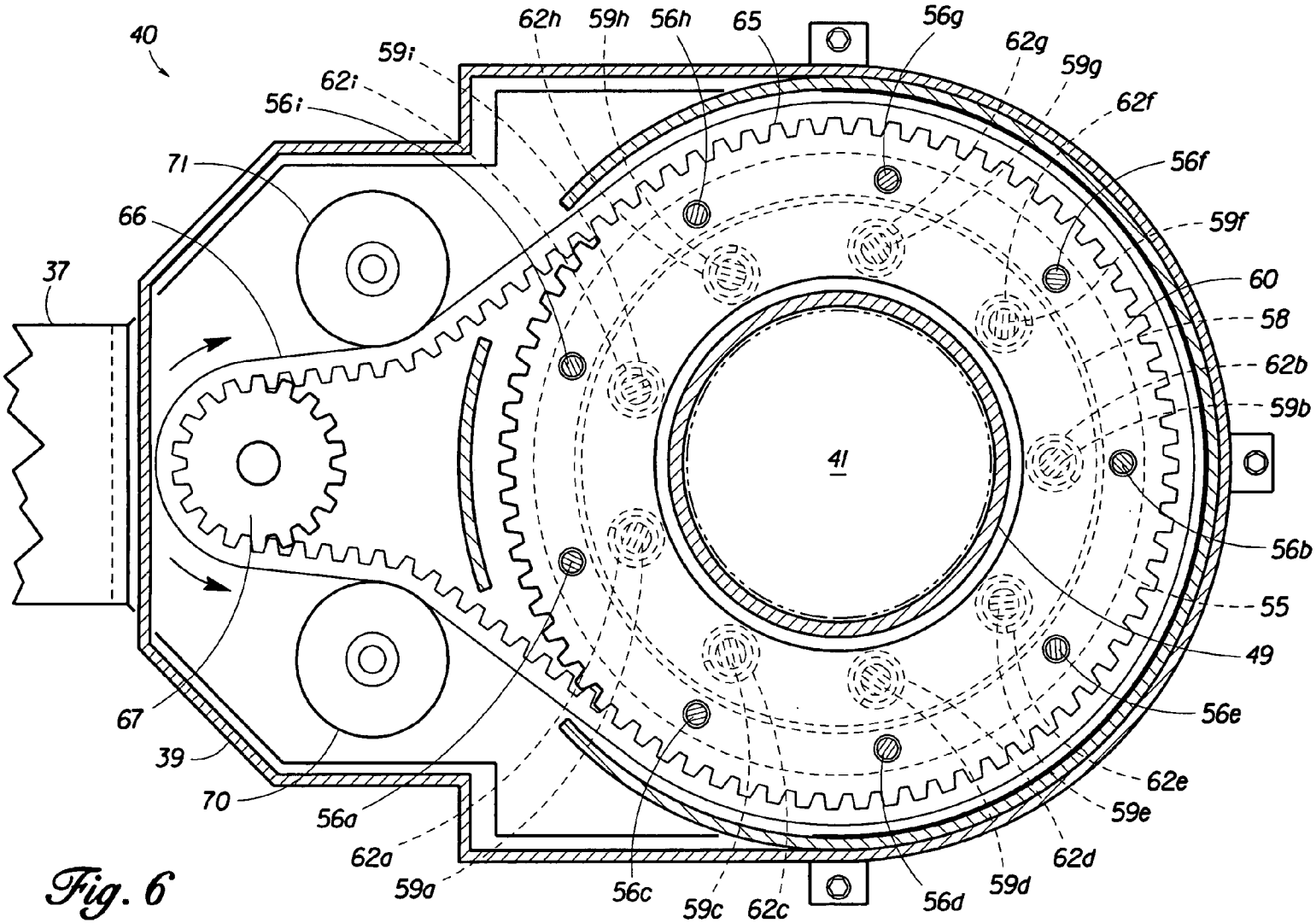
FIG. 6 is a cross-sectional view of the compensator sleeve assembly taken along line 6-6 of FIG. 4.

FIG. 6 shows a cross-sectional top view of the compensator sleeve assembly 40. Welded to the adjustable arm slide 37 is the steel plate 39, which has been bored out to accommodate cut steel pipe 55. Disposed therein is the sleeve 49 holding the safety valve 41. Rotator rods 59*a*, 59*b*, 59*c*, 59*d*, 59*e*, 59*f*, 59*g*, 59*h*, 59*i* have been inserted through openings in the sleeve support flange 58, spaced circumferentially apart 40° from one another. An upper spring 62*a*, 62*b*, 62*c*, 62*d*, 62*e*, 62*f*, 62*g*, 62*h*, 62*i* has been placed over an upper end of each rotator rod 59*a*, 59*b*, 59*c*, 59*d*, 59*e*, 59*f*, 59*g*, 59*h*, 59*i*, which has each been inserted into one of the drilled openings in the underside of upper steel block 60. Set screws 56*a*, 56*b*, 56*c*, 56*d*, 56*e*, 56*f*, 56*g*, 56*h*, 56*i* are screwed into cut steel pipe 55 to hold the assembly in place. The number of rotator rods with springs can vary according to the size and weight of the safety valve 41 being supported by the device. The gear cog sprocket 65 installed around the perimeter of upper steel block 60 is engaged by the power chain drive belt 66, which is driven by the rotation of drive gear sprocket 67. Idler bearings 70, 71 maintain pressure on the drive belt 66 so that it doesn't slip as it turns the entire compensator sleeve assembly 40. The drive belt 66 can turn clockwise or counter-clockwise, depending on whether it is screwing in the safety valve 41 or breaking it out.

Figure 7B:
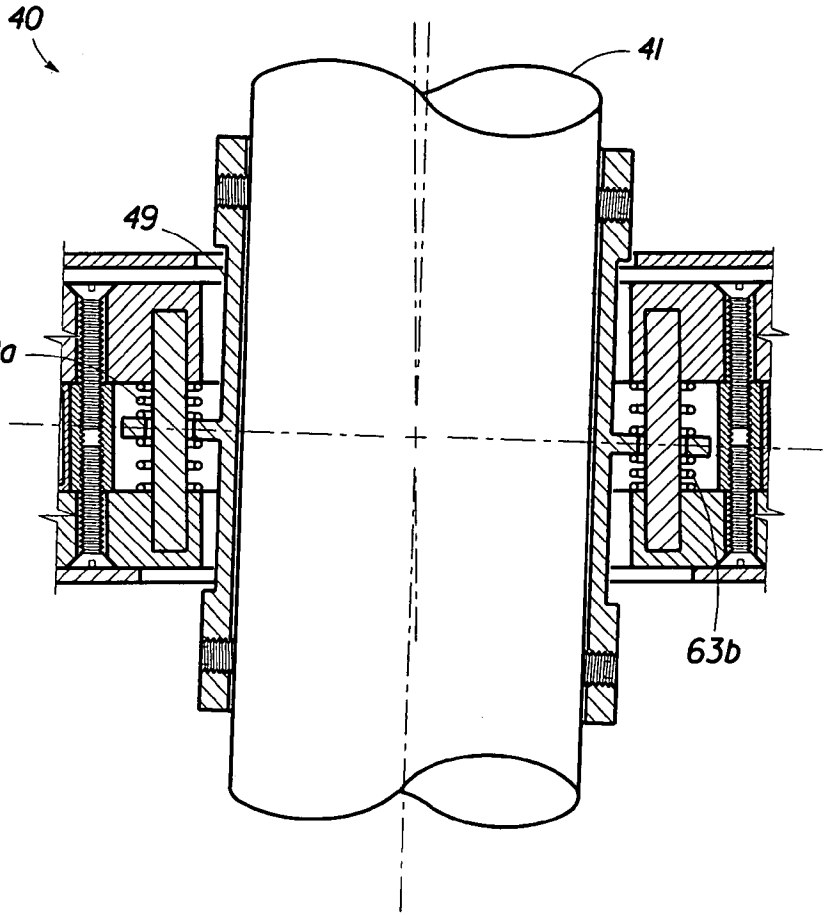
FIGS. 7A and 7B are cross-sectional side views of the compensator sleeve assembly, showing the compression of the springs as the safety valve tilts at two different angles from the valve's vertical centerline.
Figure 7A:
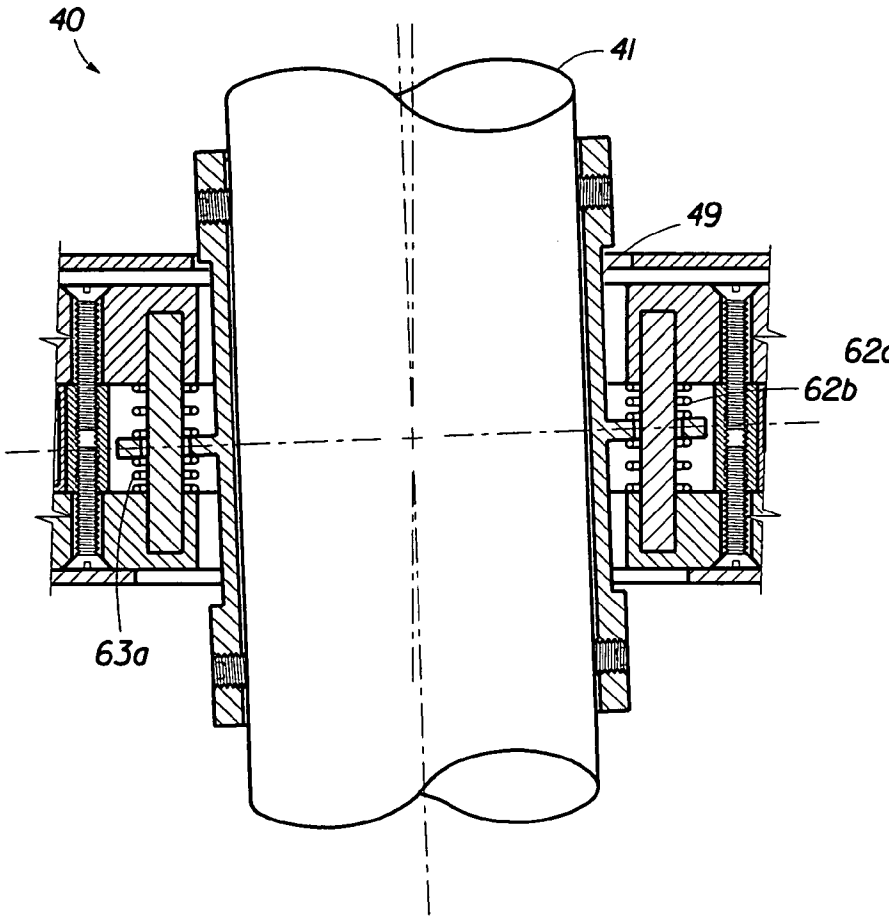

FIGS. 7A and 7B show how the compensator sleeve assembly 40 of the present invention can "compensate" when the safety valve is being used with a rig on an uneven floor. When the safety valve 41 is being screwed into the box end 46 of drill pipe, it may need to tilt from vertical in order to mate with the threads of the drill pipe 20. As shown in FIG. 7A, the top of the sleeve 49 has tilted to the left, as lower spring 63*a* and upper spring 62*b* compress. In FIG. 7B, the top of the sleeve 49 has tilted to the right, as upper spring 62*a* and lower spring 63*b* compress. Each set of springs 62, 63 acts as a compensator, so that the sleeve 49 holding the safety valve 41 can "float" and tilt in any direction.

Figure 8:
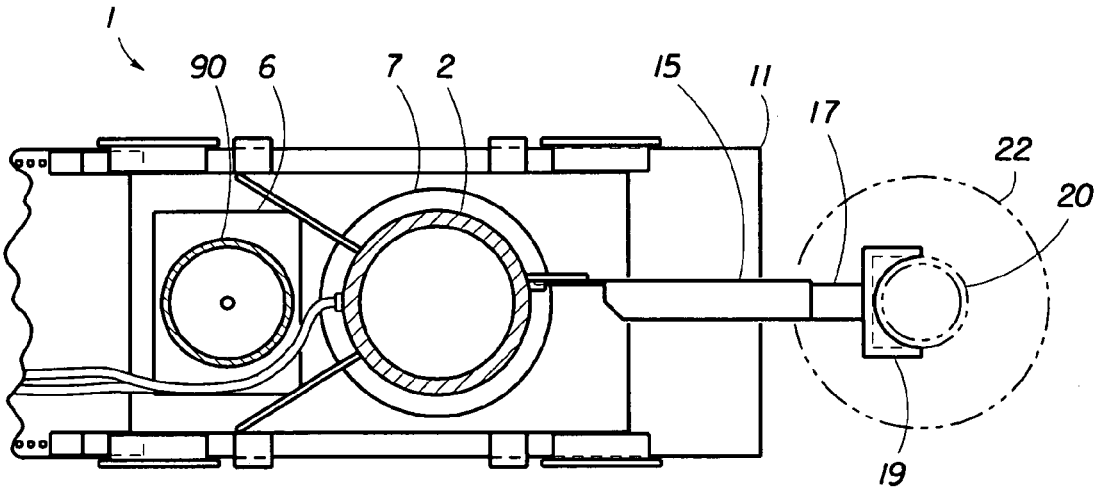
FIG. 8 is a top view of the track assembly and the positioning arm, which is used to hold the drill pipe in a vertical position.

The top view of FIG. 8 shows the yoke 19, held by yoke slide 17 and positioning bar slide 15, after it has been positioned against drill pipe 20, which is supported by rotary table 22. The positioning bar slide 15 is swivel-mounted to hydraulic unit 2, which is bolted onto the base 6 by base plate 7. The track assembly 11 is described supra.

Figure 9:
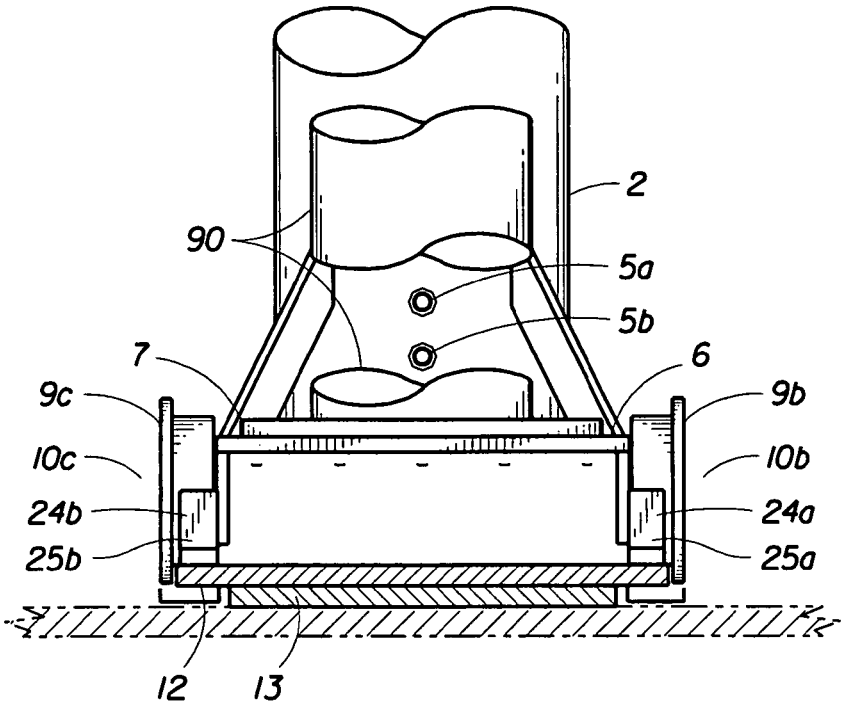
FIG. 9 is a rear view of the hydraulic unit, the base and the track assembly of the present invention.

In FIG. 9, the opening for hydraulic hoses 5*a*, 5*b* can be seen on hydraulic unit 2, which is bolted onto the base 6. The flanges of wheels 9*b*, 9*c* extend over the sides of upper track plate 12. Locking stops 24*a*, 24*b*, held in place by locking pins 25*a*, 25*b*, keep the hydraulic unit 2 from rolling away from the drill pipe 20.

Figure 10:
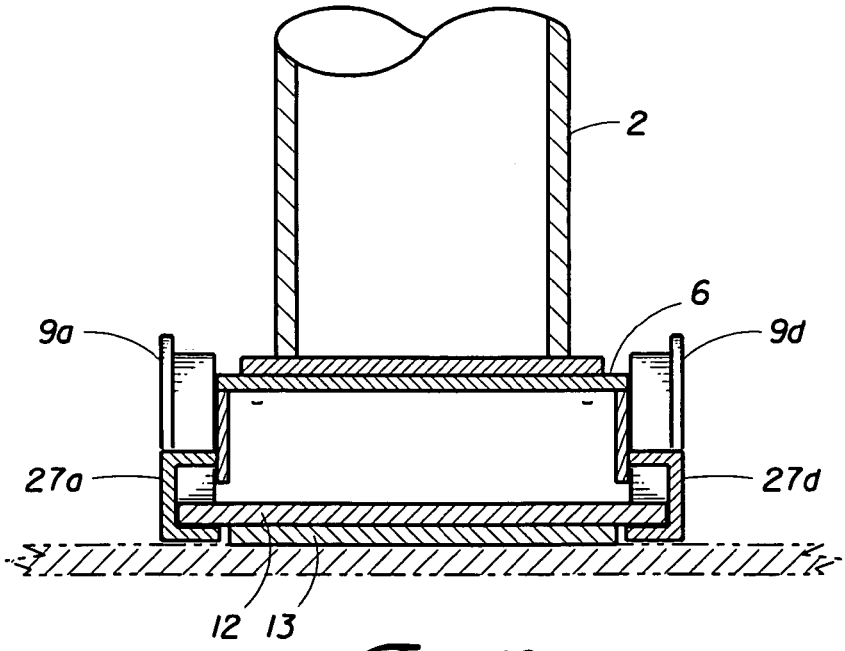
FIG. 10 is a cross-sectional view of the track assembly and the safety clamps of the present invention.

In FIG. 10, the functioning of the safety clamps 27*a*, 27*d* (27*b*, 27*c* not shown) can be more easily understood. The upper ends of the channel-shaped steel safety clamps 27*a*, 27*d* are welded to the sides of the base 6. The lower ends of the safety clamps 27*a*, 27*d*, are positioned under the lower side of upper track plate 12. The lower track plate 13 is not as wide as the upper track plate 12, thereby allowing the safety clamps 27*a*, 27*b*, 27*c*, 27*d* to slide along horizontally under the upper track plate 12. The safety clamps 27*a*, 27*b*, 27*c*, 27*d* prevent any vertical movement of the base 6 and the hydraulic unit 2 attached thereto by base plate 7.

Although the present invention is described with the hydraulic unit mounted on tracks, an embodiment using caster wheels is also envisioned.

Figure 11:
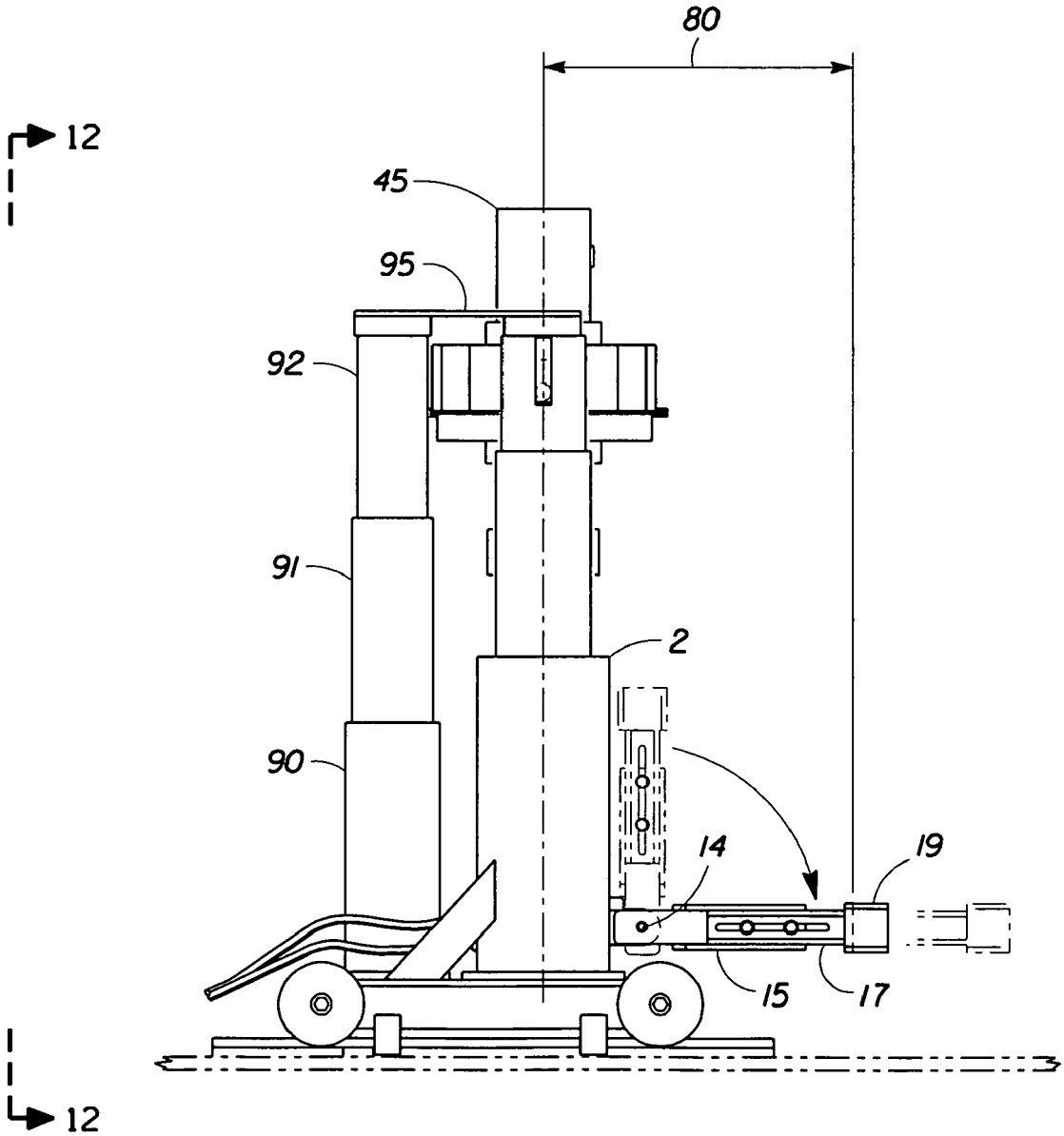
FIG. 11 is a side view of the present invention showing the positioning arm rotated between a stored position and an operational position for vertical positioning of the safety valve.

In FIG. 11, the compensator sleeve assembly 40 is in the ready position behind the hydraulic unit 2; the upper opening 45 of the safety valve can be seen. The yoke 19 has been rotated downward 90°, using the swivel 14, from the stored position to the operational position. When the yoke 19 rests against the drill pipe or tubing 20 (not shown), the measurement of the distance at 80, from the centerline of the hydraulic unit 2 to the inner circumference of the yoke 19 provides information for adjustment of the position of the compensator sleeve assembly 40. Further extension of the yoke 19 is accomplished by adjusting the positioning bar slide 15 and the yoke slide 17. Alternatively, hydraulic tongs can be used.

Figure 12:
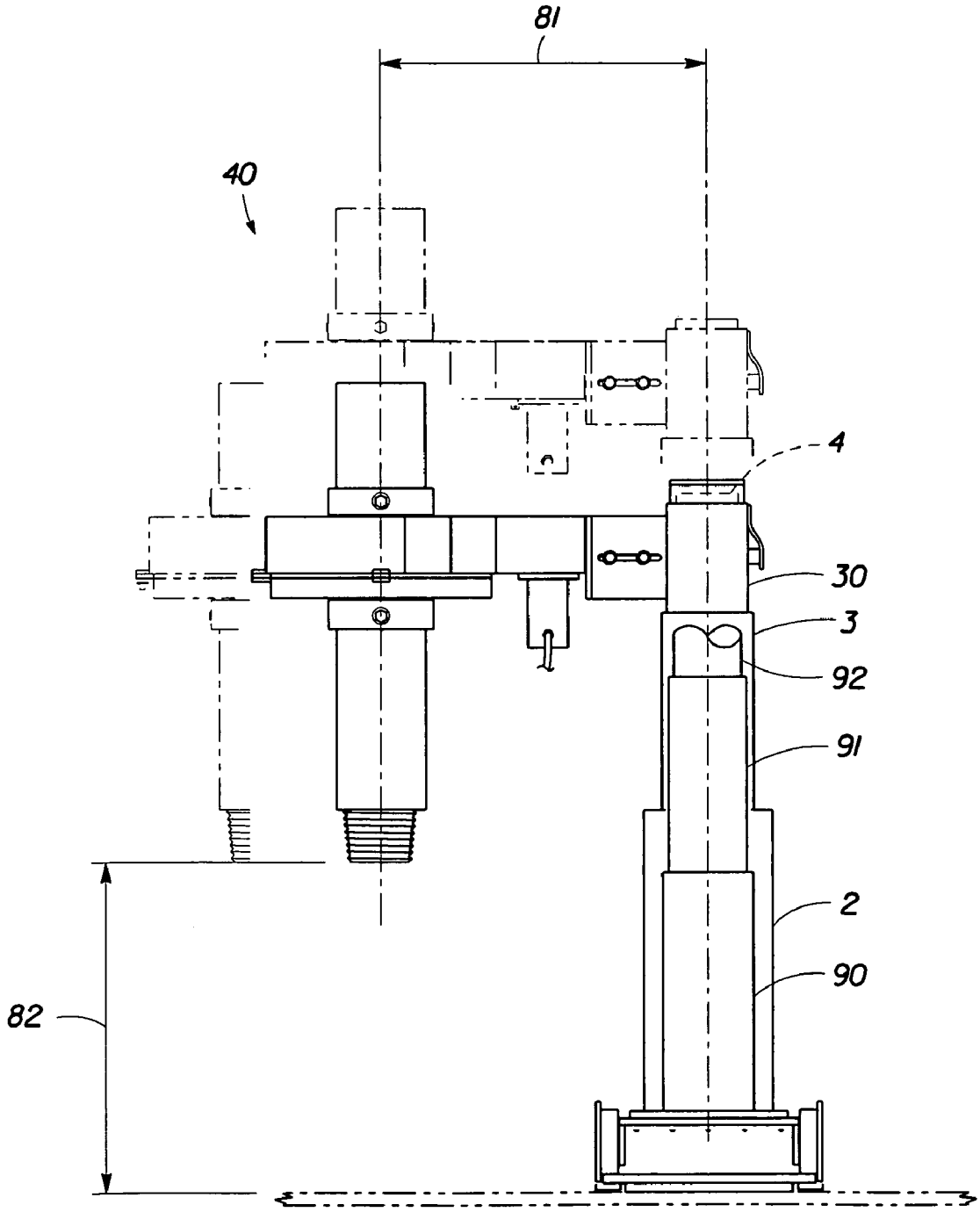
FIG. 12 is a back view of the present invention, showing how the extended arm can be raised and extended in order to position the safety valve over the drill pipe.

In FIG. 12, at 81, a measurement is made of the compensator sleeve assembly 40 relative to the hydraulic unit 2. The measurement is made from the centerline of the safety valve 41 to the centerline of the hydraulic unit 2 and is correlated to the measurement 80, supra in FIG. 8. Adjustments to the position of the compensator sleeve assembly 40 can be made, if necessary, by adjusting the extended arm slide 35 and the adjustable arm slide 37. The object of the adjustments is to insure that the safety valve 41 can be properly aligned with and threaded into the drill pipe or tubing 20 (not shown). The measurement made at 82 determines whether the safety valve 41 needs to be raised or lowered (it must be high enough to clear the top of the drill pipe or tubing 20), using hydraulic unit 2, which raises and lowers compensator sleeve assembly 40.

Figure 13A:
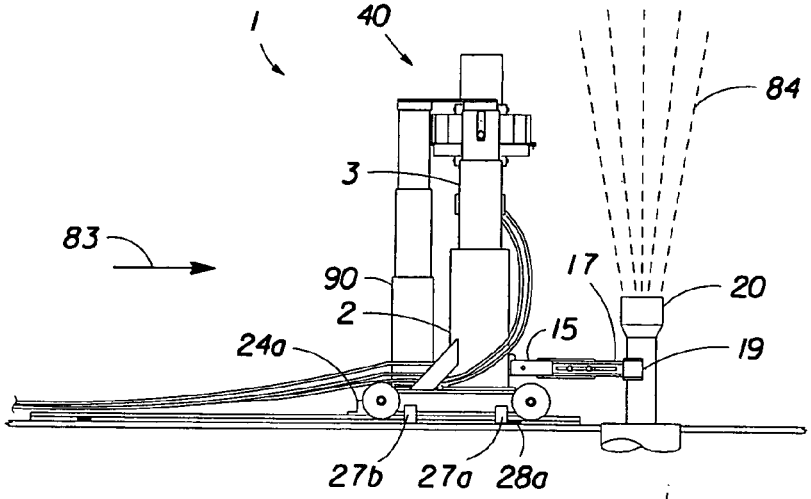
FIGS. 13A through 13C show the sequence of operations required to utilize the present invention in order to shut off upward flow from a drill pipe.

In FIG. 13A, compensator sleeve assembly 40 is behind hydraulic unit 2 in a ready position. The apparatus 1 is moved in the direction of arrow 83, towards the drill pipe 20, until the yoke 19 rests against drill pipe 20, from which an upward flow 84 of gas and liquids is escaping. Locking stop 24*a* is in place, as are safety clamps 27*a* and 27*b*, and block 28*a*, all utilized to prevent unwanted movement of the apparatus 1.

Figure 13B:
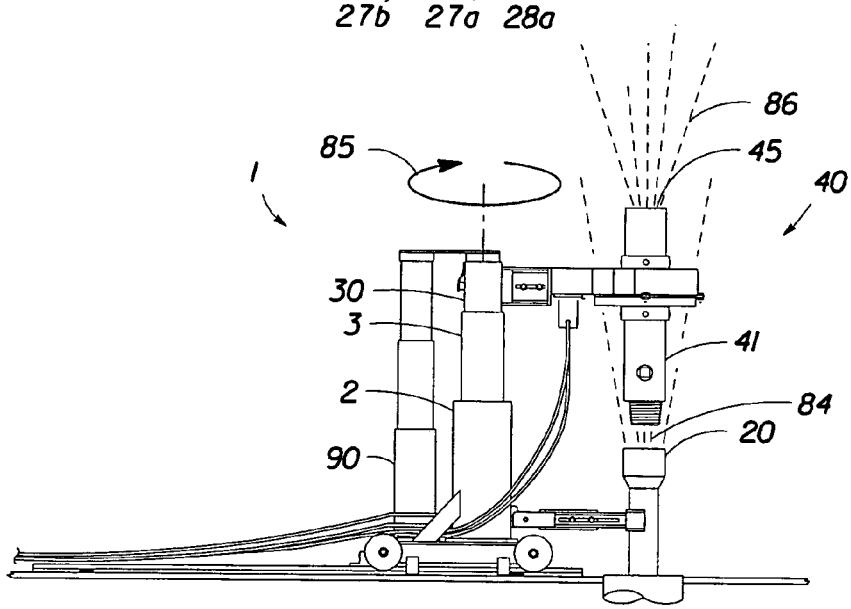

In FIG. 13B, the compensator sleeve assembly 40 has been rotated (arrow 85) to position. the safety valve 41 over the drill pipe 20. The upward flow 84 of gas and liquids has been diverted through the safety valve 41 to flow out 86 through the upper opening 45 of the safety valve 41.

Figure 13C:
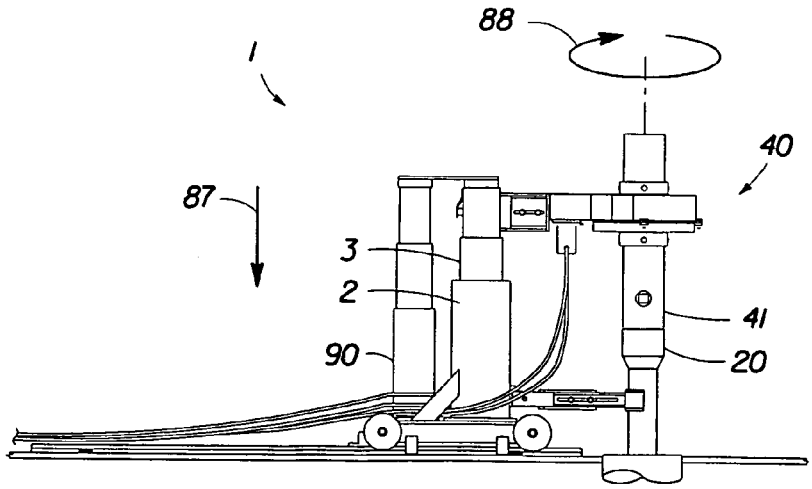

In FIG. 13C, the hydraulic unit 2 performs a downward movement at 87, while the safety valve 41 is rotated (at arrow 88), thereby threading the safety valve 41 into the drill pipe 20.

The information in the disclosure and description of the invention itself are illustrative only of the application of the principles of the present invention. Modifications and alternative embodiments may be devised by those skilled in the art without departing from the spirit and scope of the present invention.

I claim:

1. Apparatus for holding a safety valve used to shut off upward flow from a conduit supported by a rotary table, said conduit having a threaded joint at its upper end, the apparatus comprising:

a hydraulic support unit;

an adjustable arm attached to the support unit;

means for adjusting the arm's position;

a spring-mounted steel sleeve for holding the safety valve in a generally vertical position;

means for mounting the steel sleeve onto the adjustable arm, such means allowing the steel sleeve to tilt several degrees from the vertical position, in any direction;

means for rotating the steel sleeve holding the safety valve.

2. Apparatus for holding a safety valve used to shut off upward flow from a conduit supported by a rotary table, said conduit having a threaded joint at its upper end, the apparatus comprising:

a support unit;

an adjustable arm attached to the support unit;

means for adjusting the arm's position;

a compensator sleeve apparatus comprising:

a steel plate attached to the adjustable arm, the steel plate having a bore;

a bearing disposed around the bore of the steel plate;

a steel sleeve for holding a safety valve in a vertical position;

a sleeve support flange extending from the sleeve's outer circumference, in a central position, the sleeve support flange having a plurality of spaced-apart openings;

a plurality of rods, each one being inserted through one of the openings in the steel support flange;

a first steel block having a bore and a bottom side having a plurality of spaced-apart indentations;

a second steel block having a bore and a top side having a plurality of spaced-apart indentations;

a plurality of springs, each one being disposed around a first end of one of the rods before the first end of the rod is inserted into one of the indentations on the bottom side of the first steel block;

a plurality of springs, each one being disposed around a second end of one of the rods before the second end is inserted into one of the indentations on the top side of the second steel block;

means for holding the pluralities of springs in a compressed state between the first steel plate and the second steel plate;

means for rotating the first steel block and the second steel block along with the sleeve holding the safety valve.

3. The apparatus of claim 2 wherein the means for holding the pluralities of springs in a compressed state comprises having both the first steel plate and the second steel plate drilled thereby providing spaced-apart openings, providing a steel pipe having a wall with spaced-apart axial openings, the steel pipe being disposed inside the bore of the steel plate between the bottom side of the first steel block and the top side of the second steel block, and having each one of a plurality of fasteners inserted through one of the openings in the first steel block, one of the axial openings of the wall of the steel pipe, and one of the openings in the second steel block, each of the fasteners being tightened.

4. The apparatus of claim 2 wherein the means for rotating the first steel block and the second steel block along with the sleeve holding the safety valve comprises a gear cog sprocket welded to the first steel block, a drive gear sprocket, and a chain drive belt disposed on the gear cog sprocket and the drive gear sprocket.

5. The apparatus of claim 4 wherein a hydraulic system provides power to drive the chain drive belt.

6. A method for shutting off upward flow from a conduit supported by a rotary table, the conduit having a threaded joint at its upper end, comprising:

placing a safety valve into a compensator sleeve assembly attached to a hydraulic support unit located on a rig floor, the safety valve having an open position and a closed position, and further having a threaded lower end for engagement with the threaded joint, and the compensator sleeve assembly having a spring-mounted sleeve holding the safety valve;

moving the support unit a premeasured distance from the conduit, said distance insuring longitudinal alignment of the safety valve and the conduit;

raising the holding clamp to a position high enough to clear the conduit;

rotating the holding clamp until the safety valve's longitudinal axis is aligned with the conduits longitudinal axis;

lowering the holding clamp until the safety valve abuts the conduit;

screwing the threaded end of the safety valve into the threaded joint, the spring-mounted sleeve being free to move tilt from a vertical position so that the threaded end of the safety valve can mate with the threaded joint when the rotary table is not on a completely horizontal surface; and closing the safety valve.

7. The method of claim 6 in which the premeasured distance is established by using a positioning arm with a first end attached to the support unit and a second end abutting the conduit.

* * * * *